US008162683B2

(12) United States Patent
Loke et al.

(10) Patent No.: US 8,162,683 B2
(45) Date of Patent: Apr. 24, 2012

(54) MINIATURE ELECTRICAL CONNECTORS

(75) Inventors: Chee Wui Loke, Canyon Country, CA (US); George Tziviskos, Cupertino, CA (US)

(73) Assignee: Advanced Bionics, LLC, Valencia, CA (US)

( * ) Notice: Subject to any disclaimer, the term of this patent is extended or adjusted under 35 U.S.C. 154(b) by 0 days.

(21) Appl. No.: 12/779,846

(22) Filed: May 13, 2010

(65) Prior Publication Data

US 2011/0281450 A1 Nov. 17, 2011

(51) Int. Cl.
*H01R 13/64* (2006.01)

(52) U.S. Cl. ..... 439/246

(58) Field of Classification Search ..... 439/246, 439/863, 247–248

See application file for complete search history.

(56) References Cited

U.S. PATENT DOCUMENTS

| | | | | |
|---|---|---|---|---|
| 0,867,943 | A | 10/1907 | Boles | |
| 1,657,253 | A | 1/1928 | Fortin | |
| 1,800,254 | A | 4/1931 | Holmes | |
| 1,835,478 | A | 12/1931 | Eaton | |
| 2,124,461 | A | 7/1938 | Challet | |
| 2,618,678 | A | 11/1952 | Gast | |
| 2,982,935 | A | 5/1961 | Barnard | |
| 3,094,364 | A * | 6/1963 | Liagg | 439/247 |
| 3,205,468 | A | 9/1965 | Henschen | |
| 3,444,504 | A | 5/1969 | Lynch et al. | |
| 4,245,881 | A | 1/1981 | Michaels | |
| 4,374,458 | A | 2/1983 | Komada | |
| 4,632,496 | A | 12/1986 | Williams | |
| 4,698,466 | A | 10/1987 | Beck et al. | |
| 4,764,132 | A | 8/1988 | Stutz, Jr. | |
| 4,848,346 | A | 7/1989 | Crawford | |
| 4,936,800 | A * | 6/1990 | Couper et al. | 439/863 |
| 4,944,568 | A * | 7/1990 | Danbach et al. | 385/88 |
| 5,076,270 | A | 12/1991 | Stutz, Jr. | |
| 5,131,869 | A | 7/1992 | Wharton | |
| 5,257,622 | A | 11/1993 | Hooper et al. | |
| 5,261,395 | A | 11/1993 | Oleen et al. | |
| 5,392,371 | A * | 2/1995 | Morlion et al. | 385/52 |
| 5,413,595 | A | 5/1995 | Stutz | |
| 5,530,417 | A | 6/1996 | Hohider | |
| 5,704,809 | A | 1/1998 | Davis | |
| 5,707,399 | A | 1/1998 | Killander et al. | |
| 6,039,685 | A | 3/2000 | Bushek | |
| 6,099,322 | A | 8/2000 | Beloritsky et al. | |
| 6,390,843 | B1 | 5/2002 | Lim | |
| 6,430,442 | B1 | 8/2002 | Peters et al. | |
| 6,471,554 | B2 | 10/2002 | Armistead et al. | |
| 6,666,690 | B2 | 12/2003 | Ishizuka et al. | |
| 7,019,222 | B2 | 3/2006 | Vinther | |
| 7,035,689 | B1 | 4/2006 | Hawkins et al. | |

(Continued)

FOREIGN PATENT DOCUMENTS

DE 8915736 U1 3/1991

(Continued)

*Primary Examiner* — Jean F Duverne
(74) *Attorney, Agent, or Firm* — Mary Elizabeth Bush

(57) ABSTRACT

A miniature electrical connector comprising a floating and vertically orientable spring contact within but not physically secured to an electrically-conductive connector block of a female connector wherein the spring contact and connector block are designed such that the spring contact is vertically oriented and outwardly expanded when a male connector is inserted into the female connector to provide a conductive path between a male contact of the male connector and the connector block of the female connector.

21 Claims, 10 Drawing Sheets

U.S. PATENT DOCUMENTS

| | | | | |
|---|---|---|---|---|
| 7,110,827 | B2 | 9/2006 | Sage et al. | |
| 7,402,076 | B1 | 7/2008 | Lim et al. | |
| 2003/0162429 | A1 * | 8/2003 | Sato | 439/246 |
| 2004/0230268 | A1 | 11/2004 | Huff et al. | |
| 2005/0027325 | A1 | 2/2005 | Lahti et al. | |
| 2008/0255631 | A1 | 10/2008 | Sjostedt et al. | |
| 2009/0047814 | A1 | 2/2009 | Daamen | |
| 2009/0048638 | A1 | 2/2009 | Rey et al. | |
| 2009/0061694 | A1 | 3/2009 | Kawasaki et al. | |
| 2009/0258519 | A1 | 10/2009 | Dilmaghanian | |
| 2009/0264943 | A1 | 10/2009 | Barker | |

FOREIGN PATENT DOCUMENTS

| | | | |
|---|---|---|---|
| WO | 89/05170 | A1 | 6/1989 |
| WO | 95/10324 | A1 | 4/1995 |
| WO | 2009131874 | A2 | 10/2009 |
| WO | 2009131874 | A3 | 1/2010 |

* cited by examiner

Fig. 3
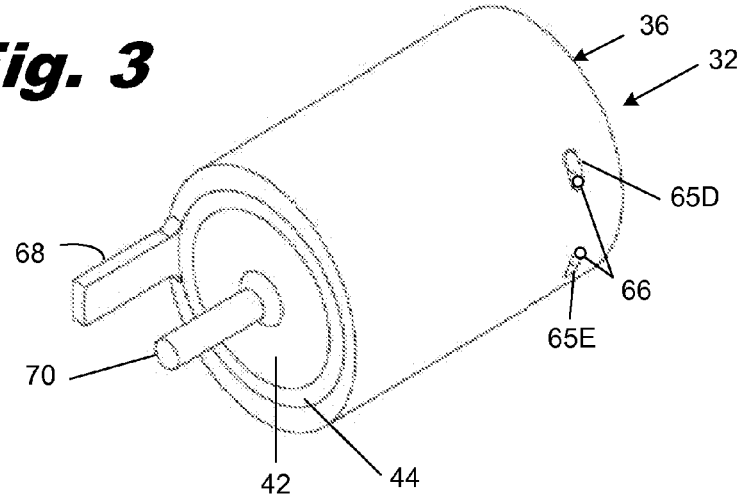
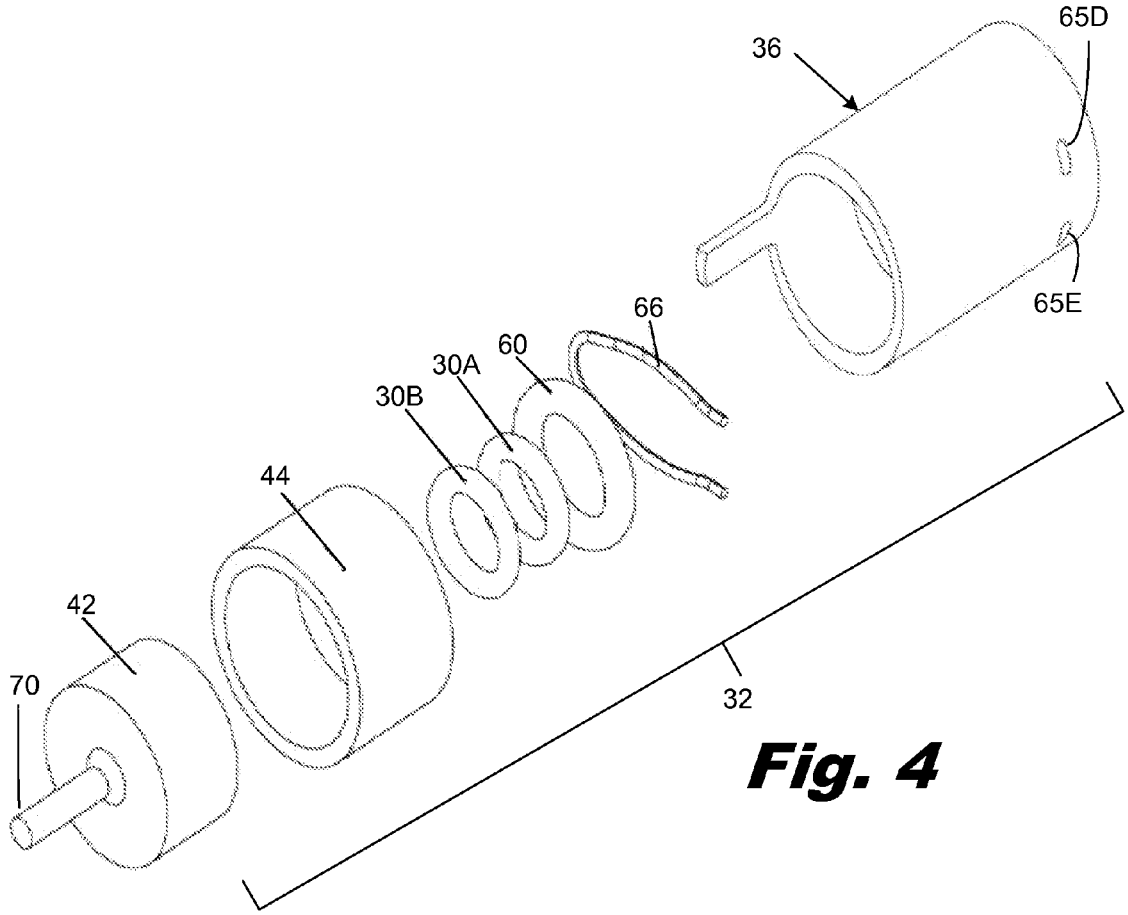
Fig. 4

Fig. 5A
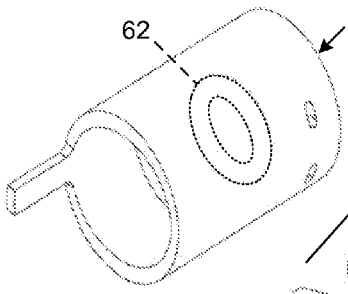
Fig. 5B
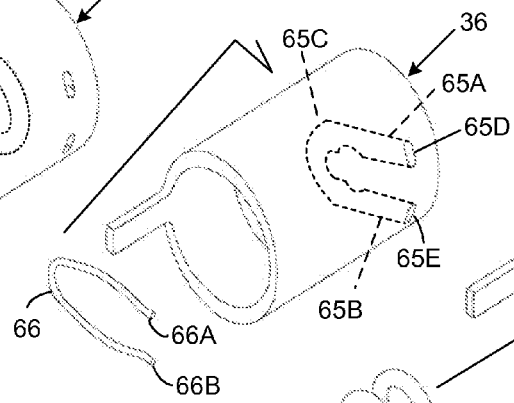
Fig. 5C
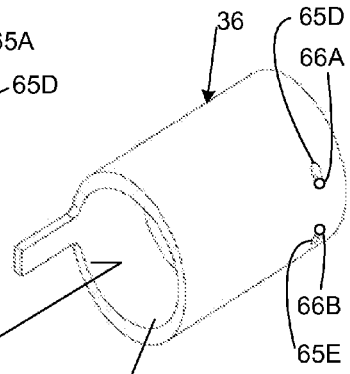
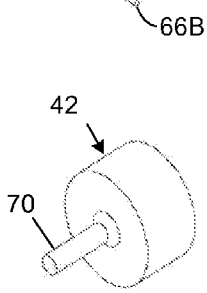
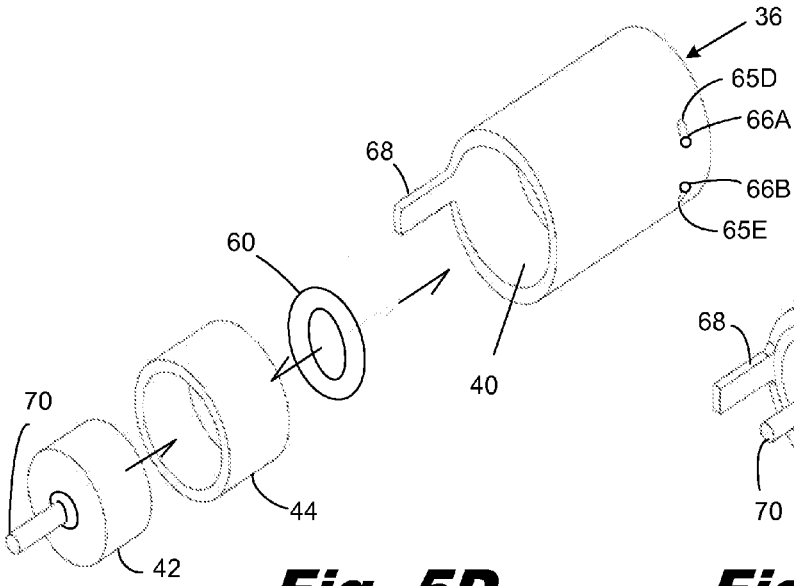
Fig. 5D
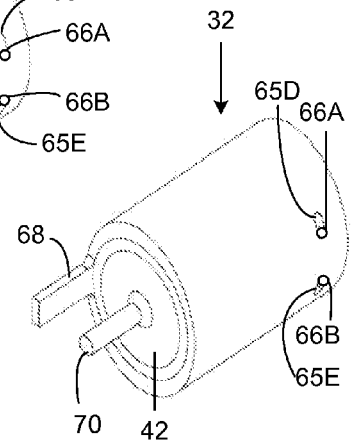
Fig. 5E Fig. 7C
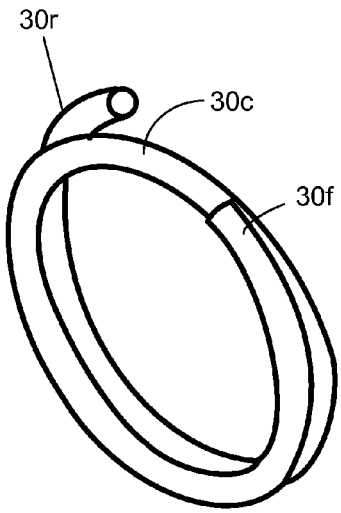
Fig. 7A
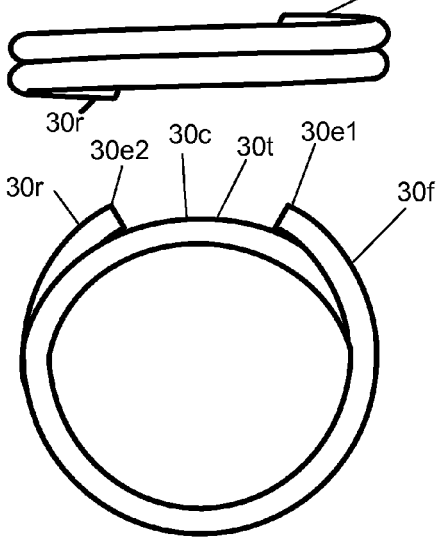
Fig. 7B
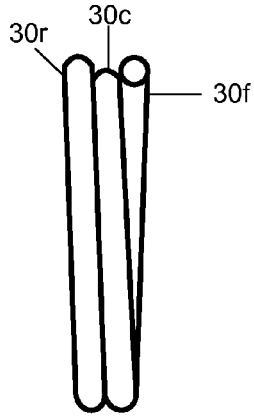
Fig. 7D
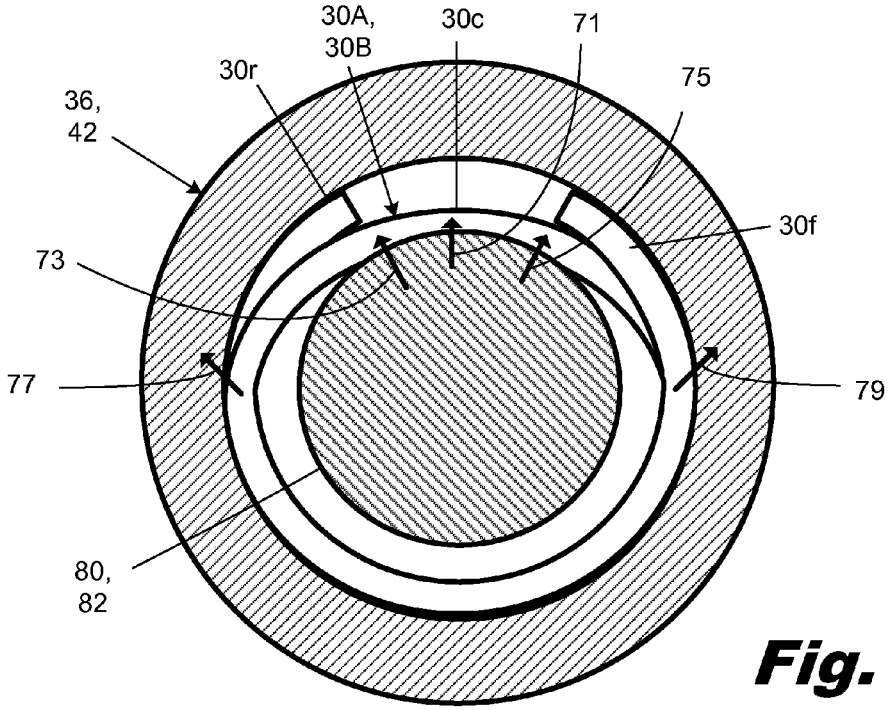
Fig. 7E Fig. 9
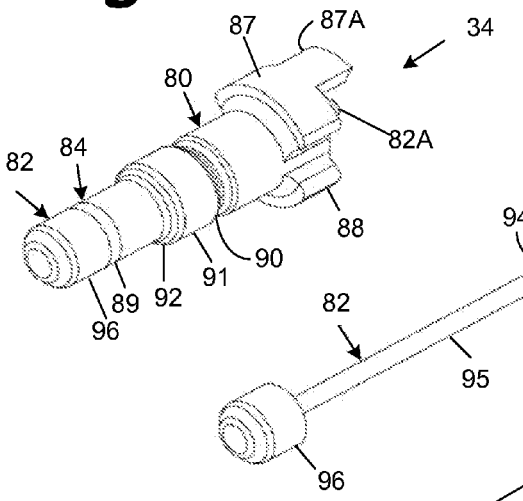
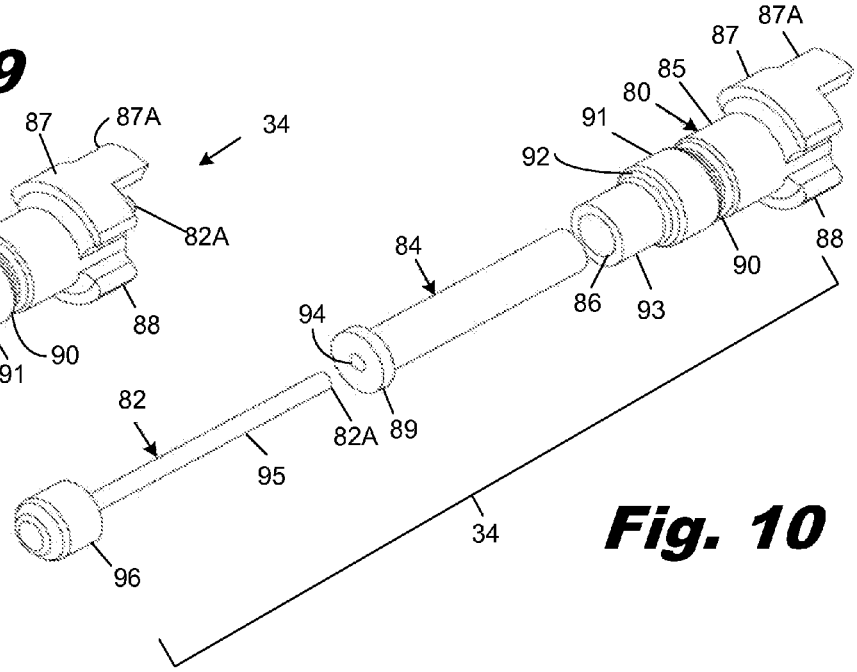
Fig. 10
Fig. 11A
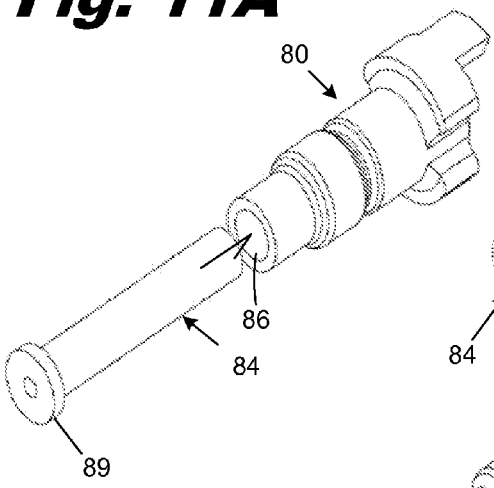
Fig. 11B
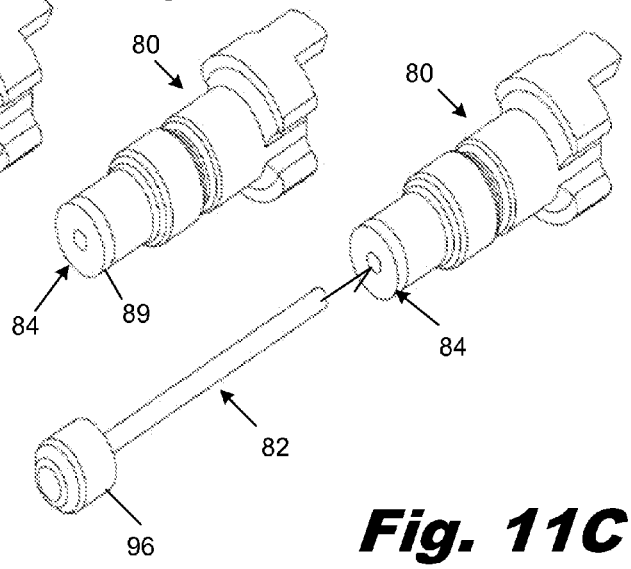
Fig. 11C

MINIATURE ELECTRICAL CONNECTORS

FIELD OF INVENTION

The present invention relates to electrical connectors and, more particularly, to miniature electrical connectors useful in cochlear implant systems.

BACKGROUND OF INVENTION

Cochlear implant systems commonly comprise external and implanted components. The external components usually include a battery-powered processor for receiving sounds, converting them into coded electrical signals, and transmitting the signals via a headpiece to the implanted components of the system. The coded electrical signals are further processed within the implanted components and transmitted to an implanted cochlear electrode where they stimulate the cochlea of the system user to produce sensations representative of the sounds received by the external processor.

The battery-powered processor of the external portion of a cochlear implant system is commonly secured behind the ear of the system user by an earpiece or to a belt or other clothing of the system user by a suitable fixation device. In either case, the coded electrical signals generated in the processor are transmitted by a cable connected between the processor and a headpiece secured to the head of the system user adjacent a signal receiving coil included in the implanted components of the system.

The connections of the external signal processor to the cable and the cable to the headpiece are by electrical connectors. Such electrical connectors form important building blocks of the cochlear implant system, as well as many other electronic systems and components. In these regards, it is important that electrical connectors be a small as possible while meeting all of the manufacturing, physical strength, reliability of operation, and electrical conductivity requirements of the systems with which they are associated. Furthermore, at least in the case of cochlear implant systems where it is desired to promote freedom of movement for the system user under different physical conditions including bathing and recreational activities, it is desired that such electrical connectors be highly durable, weather-resistant, and preferably waterproof. Other desirable connector features are low cost, ease of manufacturing, and ease of insertion including orientation independence and one step insertion and securing. The miniature electrical connectors of the present invention meet and exceed all of the foregoing requirements and expectations.

SUMMARY OF INVENTION

Basically, the miniature electrical connectors of the present invention satisfy all of the foregoing requirements by comprising a floating vertically orientable spring contact loosely supported within, but not physically secured to, an electrically-conductive connector block of a female connector wherein the spring and connector block are designed such that the floating spring contact is vertically oriented within the connector block and outwardly expands as a male connector is inserted into the female connector to provide a conductive path between a male contact on the male connector and the connector block.

In an illustrative embodiment, the female miniature electrical connector of the present invention is of a coaxial design and comprises (i) a first connector block comprising a cylindrical axially extending outer shell contact formed of electrically conductive material and having open forward and rear ends and (ii) a second connector block comprising a cylindrical axially extending center end contact of electrically conductive material within the open rear end of and insulated from the outer shell contact.

In the illustrative embodiment, two separate floating spring contacts are each supported within a connector block of the female electrical connector of the present invention. As will be apparent to one skilled in the art, any number of such contacts, each comprising a floating spring contact within a connector block, may be used. A first one of the floating spring contacts is supported within the outer shell contact to expand upon the axial insertion of a male connector into the female connector and provide a conductive path between a male side contact of the male connector and outer shell contact of the female connector. A second one of the floating spring contacts is supported within the center end contact to expand upon the axial insertion of the male connector into the female connector and provide a conductive path between a male center pin contact and the center end contact of the female connector. Such spring geometries allow for a very compact connector designs that are less than 7 mm in length and less than 4 mm in diameter, self contained, and easy to encapsulate, and therefore highly suitable for waterproof connectors.

The foregoing as well as other structural features of the present invention may be more fully understood by reference to the following detailed description referring to the drawings briefly described as follows.

BRIEF DESCRIPTION OF DRAWINGS

FIG. 3 is a perspective view of the female miniature electrical connector shown in FIG. 2.

FIG. 4 is an axially exploded view of the components of the female miniature connector shown in FIGS. 2 and 3 including the outer shell contact, the center end contact, and the floating spring contacts.

FIGS. 5A-5E depict the steps of assembly of the components shown in FIG. 4 to form the miniature female connector of FIG. 2.

FIGS. 6A-6D are perspective, front, top, and side views of a crab spring contact comprising a first design for a floating spring contact for inclusion in the miniature female electrical connector of the present invention as depicted in FIG. 2, while

FIGS. 7A-7D are perspective, front, top, and side views of a wire spring contact comprising a second design for a floating spring contact for inclusion in the miniature female electrical connector of the present invention as depicted in FIG. 2, while FIG. 7E is a front view of the wire spring contact within a female connector block as it is engaged by a male contact as shown in FIG. 2.

FIGS. 8A-8B are front and side views of a semi-arc wire spring contact comprising a third design for a floating spring contact for inclusion in the miniature female electrical connector of the present invention as depicted in FIG. 2, while

FIG. 9 is a perspective view of the male contact shown in FIG. 2.

FIG. 10 is an axially exploded view of the components of the male contact shown in FIGS. 2 and 9, including an electrically-conductive side contact, a conductive center pin, and an insulator sleeve.

FIGS. 11A-11C depict the steps of assembly of the components shown in FIG. 10 to form the male connector shown in FIGS. 2 and 9.

DETAILED DESCRIPTION OF INVENTION

As previously indicated, the miniature electrical connector assembly of the present invention basically comprises a female connector and a male connector, the female connector comprising a floating vertically orientable spring contact loosely supported within an electrically-conductive connector block wherein the spring contact and connector block are designed such that the spring contact is vertically oriented and outwardly expands as the male connector is inserted into the female connector to provide a conductive path between a male contact of the male connector and the electrically-conductive connector block of the female connector. Such miniature electrical connectors may be usefully employed in various systems requiring highly compact connector design and the capability of being weather resistant or encapsulated in a waterproof material. Thus, it is by way of example only that FIGS. 1A and 1B depict a cochlear implant system 10 in which waterproof miniature electrical connector assemblies 12 and 14 constructed according to the present invention may be usefully employed.

Figure 1A:
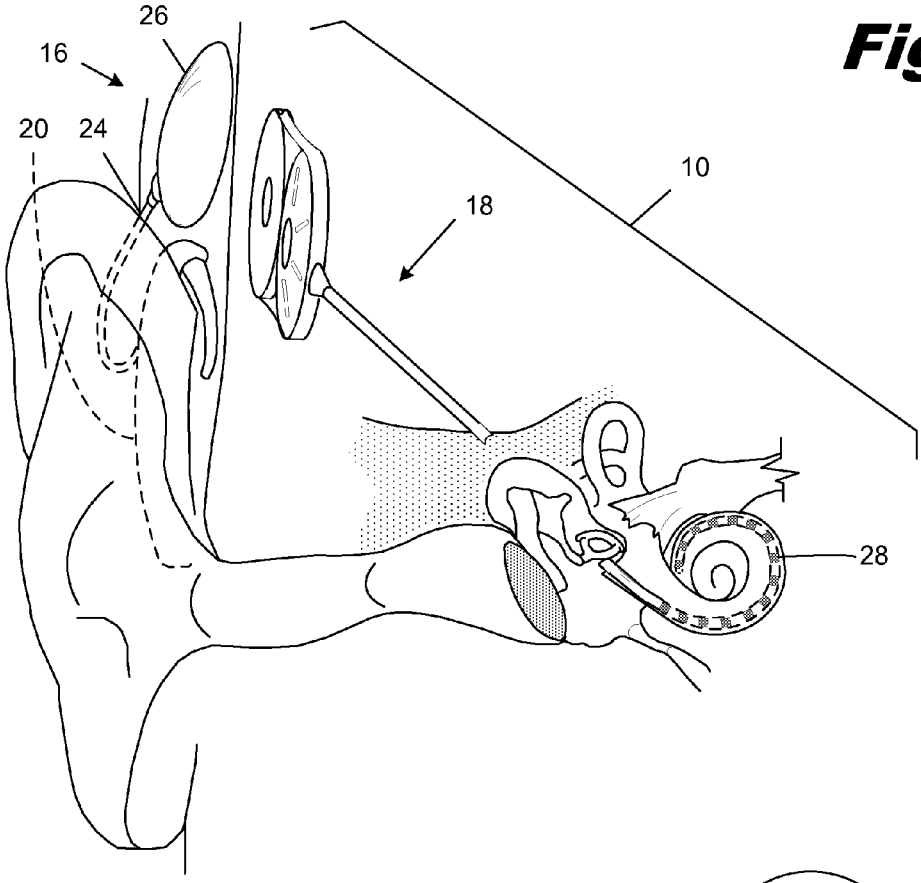
FIG. 1A is an illustration of a cochlear implant system including miniature electrical connectors of the present invention. In the illustrated cochlear implant system an external signal processor is housed within a housing worn behind the ear of a system user. Coded sound signals generated thereby are transmitted by a cable to a headpiece located adjacent implanted components of the cochlear implant system where they are decoded and transmitted to an implanted cochlear electrode to stimulate the cochlea of the system user and produce sensations representative of the sounds received by the external signal processor.
Figure 1B:
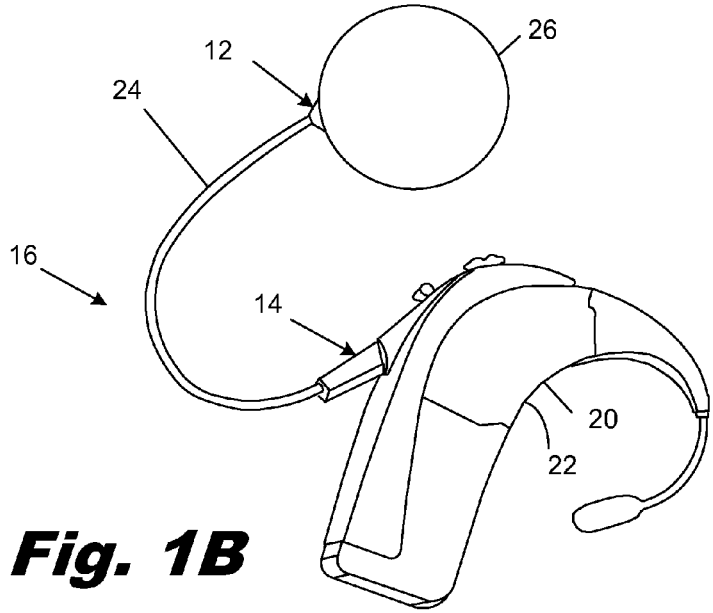
FIG. 1B is a perspective illustration of the external components of the cochlear implant system shown in FIG. 1A.

As is common in cochlear implant systems, the system 10 depicted in FIGS. 1A and 1B comprises external components 16 and implanted components 18. The external components 16 include a signal processor 20 housed, by way of example only, in a behind-the-ear (BTE) housing 22 worn behind the ear of a system user. In the system 10, sound signals received by the signal processor 20 are converted into coded sound signals that are transmitted by a cable 24 to a headpiece 26 located adjacent the implanted components 18. Within the implanted components 18 the coded sound signals are decoded and transmitted to an implanted cochlear electrode 28 to stimulate the cochlea of the system user and produce sensations representative of the sounds received by the external signal processor 20.

As depicted in FIGS. 1A and 1B, the miniature electrical connectors of connector assemblies 12 and 14 are encapsulated in a waterproof material and connected to opposite ends of the cable 24 to connect the cable to the signal processor 20 and to the headpiece 26. In that regard, the following description of the electrical connector assembly 12 applies equally to the electrical connector assembly 14.

Figure 2:
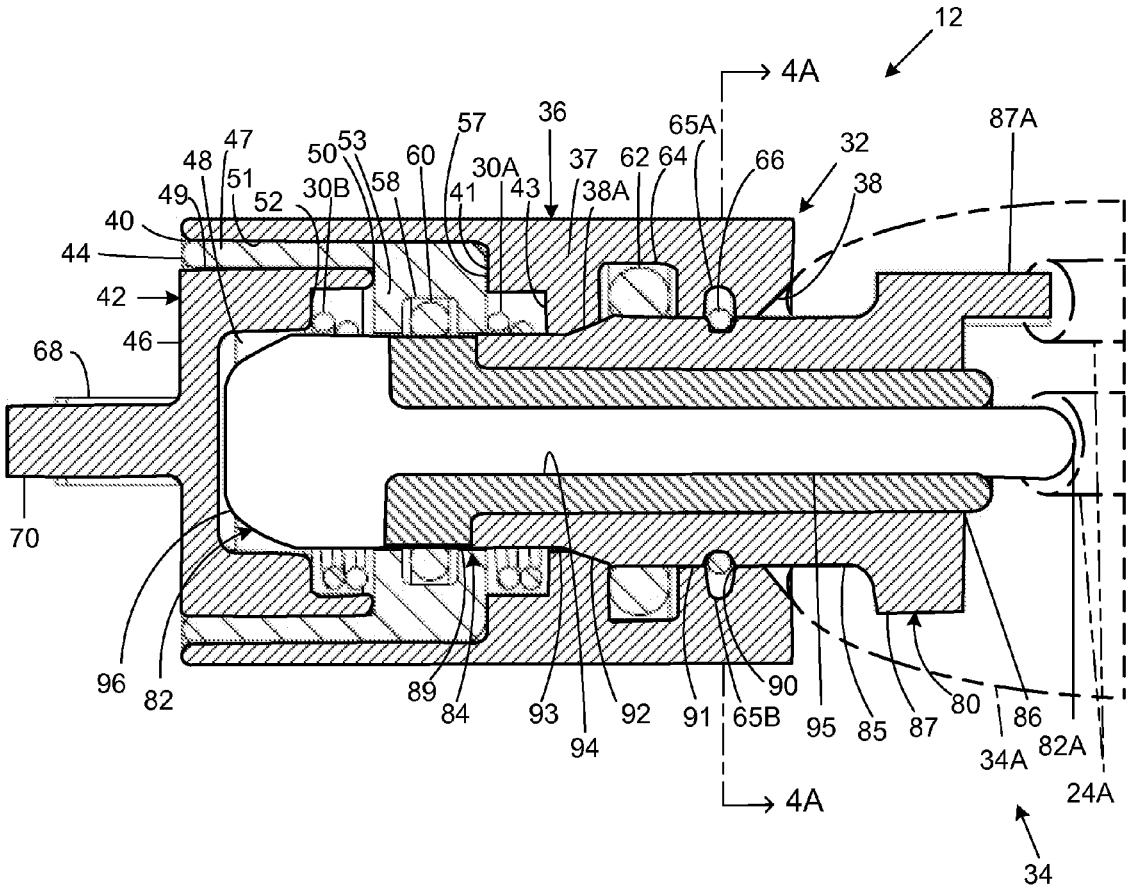
FIG. 2 is an axial cross-sectional view of an illustrative embodiment of the miniature female electrical connector of the present invention with an externally encapsulated male connector extending axially therein to provide separate conductive paths from a male side contact to an outer shell contact and from a male center pin contact to a center end contact of the female electrical connector via floating spring contacts.

As shown in axial cross-section in FIG. 2, the miniature electrical connector assembly 12 of the present invention comprises a female connector 32 and a male connector 34 having an external waterproof covering 34A and connections 24A to the cable 24 indicated in phantom outline. The female connector 32 comprises one or more floating spring contacts 30A and 30B, each within an electrically-conductive connector block of a female connector 32, which may comprise, for example, brass. The spring contacts comprise, for example, MP35N® metal alloy, BeCu, or Elgiloy® metal alloy. The spring contacts 30B and 30B and the connector blocks are designed such that the spring contacts expand when the male connector 34 is inserted into the female connector 32 to provide conductive paths between a male contact and the respective electrically-conductive connector block.

In an illustrative embodiment, the female miniature electrical connector 32 of the present invention is of a coaxial design and comprises (i) a first connector block comprising a cylindrical axially extending outer shell contact 36 formed of electrically conductive material and having open forward and rear ends 38 and 40, respectively, and (ii) a second connector block comprising a cylindrical axially extending center end contact 42 of electrically conductive material within the open rear end 40 of and insulated from the outer shell contact 36.

In the illustrative embodiment, two separate floating spring contacts 30A and 30B are each loosely supported within a connector block of the female electrical connector 32 of the present invention. The forward spring contact 30A is loosely supported within the outer shell contact 36 to be vertically oriented and outwardly expanded upon the axial insertion of the male connector 34 into the female connector 32 and provide a conductive path between a side contact 80 at the rearward end of the male connector and the outer shell contact 36 of the female connector. The rearward spring contact 30B is loosely supported within the center end contact 42 to be vertically oriented and outwardly expanded upon the axial insertion of the male connector 34 into the female connector 32 and provide a conductive path between a center pin contact 82 at the forward end of the male connector and the center end contact 42 of the female connector. Such a spring geometry allows for a very compact electrical connector design that is self-contained, easy to encapsulate, and therefore highly suitable for waterproof connectors as depicted in FIG. 1B.

As to the support provided by the cylindrical outer shell contact 36 for the forward spring contact 30A, as shown most clearly in FIG. 2, the rear opening 40 in the outer shell contact is cylindrical in shape and is larger than the cylindrical front opening 38. From a rear end of the opening 40 it extends forward to a mid-portion 37 of the outer shell contact 36 where it steps inward toward an axis of the outer shell to form a rearward facing circular shoulder 41. From a bottom of the shoulder 41, the cylindrical opening 40 extends forward and then steps inward toward the axis of the outer shell contact to form a cylindrical rearwardly facing open step 43 forming a cavity in which the forward spring contact 30A resides within the outer shell contact 36.

As to the support provided by the center end contact 42 for the rearward spring contact 30B, as shown in FIG. 2, the center end contact is cylindrical in shape and sized to fit axially within the open rear end 40 of the outer shell contact 36 where, as will be described in detail hereinafter, it is surrounded by an insulator 44, which electrically insulates it from the outer shell contact. The insulator 44 may comprise, for example, polyether ether ketone (PEEK) or an acetal such as Delrin® material. A rear end of the cylindrical center end contact 42 is closed by a rear back 46 forming a circular base for a forwardly facing cylindrical pocket 48 extending forward from the circular base. An outer circular end 50 of the cylindrical pocket 48 includes a circular forward facing step 52 forming a cavity for receiving the rearward spring contact 30B within the center end contact 42.

As mentioned above and as shown in FIG. 2, the center end contact 42 is surrounded by the insulator 44 and electrically insulated thereby from the outer shell contact 36. The insulator 44 includes a cylindrical portion 47 between an outer cylindrical surface 49 of the center end contact 42 and a cylindrical inner surface 51 of the outer shell contact 36. In addition, the insulator 44 includes a radial portion 53 between ends 50 of the forwardly facing pocket 48 in the center end contact 42 and a rearward facing surface 57 of the shoulder 41 of the outer shell contact 36. Thus positioned, the radial portion 53 of the insulator 44 closes a rearward open side of the open step 43, forming a cavity within the outer shell contact 36 thereby axially capturing the forward spring contact 30A within the outer shell contact.

In addition, the radial portion 53 of the insulator 44 closes a forward open side of the open step 52 in the center end contact 42 thereby axially capturing the rearward spring contact 30B within the center end contact In addition to closing the forward and rearward facing open sides of the step 43 and the step 52, radial portion 53 of the insulator 44 includes an inner circular channel 58 that supports a circular seal 60, such as a conventional rubber O-ring, comprising, for example, silicone rubber. The seal 60 is sized and shaped such that upon insertion of the male connector 34 into the female connector 32, the seal 60 expands to create a fluid tight seal between an outer surface of an insulator sleeve 84 of the male connector 34 and the insulator 44.

A similar fluid tight seal is created by a circular seal 62 within the outer shell contact 36 as shown in FIG. 2. In this regard, spaced between the forward open end of the opening 38 and the step 43 forming the cavity containing the forward spring contact 30A, an inner surface of the cylindrical outer shell contact 36 includes an annular groove 64 dimensioned to receive and axially contain the seal 62 such that upon insertion of the male connector 34 into the female connector 32, the seal 62 expands to form a fluid tight seal between the male side contact 80 and the outer shell contact 36.

Further, as depicted in FIG. 2, the portion of the male connector 34 within the female connector 32 between step 43 and the open end of the opening 38 in the outer shell contact 36 is radially enlarged relative to the balance of the male connector. To allow for such a radial enlargement, the inner surface of the opening 38 is likewise slightly enlarged to include an annular outwardly and forwardly ramped portion 38A between the step 43 and the annular groove 64. As illustrated, the ramped portion 38A functions as a forward stop for the male connector 34 as it is inserted into the female connector 32.

Figure 4A:
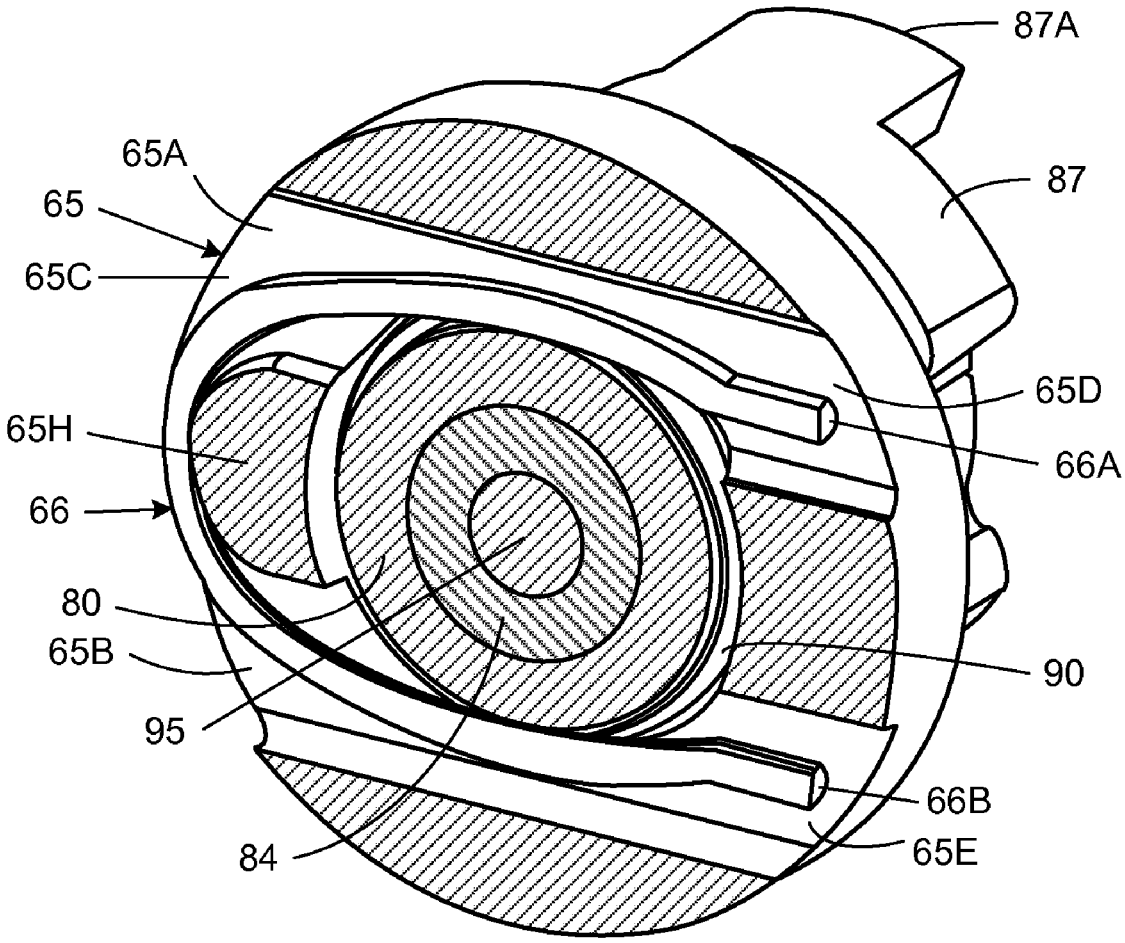
FIG. 4A is a perspective sectional view along the line 4A-4A in FIG. 2 illustrating the interior of the male side connector within the outer shell contact of the female connector and a retainer for the male connector when it is seated within the female connector.

Also, as illustrated in FIGS. 2, 3, 4 and 4A and the method of assembly of the female connector 32 illustrated in FIGS. 5A-5E, the inner surface of the opening 38 in the outer shell contact 36 forward of the annular groove 64 includes a C-shaped laterally extending slot 65 defined by inner upper and lower laterally extending grooves 65A and 65B. above and below a C-shaped hub 65H as depicted in FIG. 4A As shown in FIGS. 4A and. 5B, the laterally extending grooves 65A and 65B begin at upper and lower ends, respectively, of a vertically extending C-shaped rear side cutout opening 65C in a back of the outer shell contact 36 and extend laterally to two vertically elongated open slots 65D and 65E in a forward side of the outer shell contact. As shown in FIGS. 4A and 5C, the open slots 65D and 65E respectively receive ends 66A and 66B of an elongated C-shaped retainer or clip 66 that releasably and axially secures the male connector 34 when it has been fully inserted into the female connector 32. The retainer 66 comprises a spring material such as stainless steel.

Further, as shown in FIG. 2 and more clearly illustrated in FIG. 3 and FIG. 4, outer electrical contacts 68 and 70 extend axially rearward from the outer shell contact 36 and the center end contact 42 respectively. The contacts 68 and 70 are intended for electrical connection to other electrical receiving structures to carry electrical signals to other circuitry for further processing. For example, in the cochlear implant system 10 shown in FIGS. 1A and 1B, the contacts 68 and 70 may be electrically connected to the headpiece 26 of the cochlear implant system 10 to carry the coded sound signals generated in the processor 20 to the implanted components 18 for further processing as previously described.

Still further, by reference to the method of assembly illustrated in FIG. 5A-5E, the relative simplicity of the structural design of the female connector 32 may be more fully appreciated. In that regard, as illustrated in FIG. 5A, the first step in the method of assembly is the insertion of the seal 62 into the annular channel inside the outer shell contact 36 as depicted in FIG. 5A. That step is followed by the insertion of the retainer 66 into the outer shell contact 36 through the side cutout 65C with the upper and lower arms 66A and 66B of the retainer riding into the grooves 65A and 65B until the ends 66A and 66B extend through the openings 65D and 65E as depicted in FIGS. 5B and 5C and FIG. 2. Next, the forward spring contact 30A is inserted through the opening 40 into the outer shell contact 36 to loosely seat within the cavity formed by open step 43, and the spring contact 30B is inserted into the open pocket 48 of the center end contact 42 to loosely seat within a cavity formed by step 52 as depicted in FIG. 2. Finally, the seal 60 is inserted into the inner circular channel 58 in the insulator 44, and the center end contact 42 is inserted with a press fit into the open rear end portion of the insulator. The combination of the insulator 44 and the center end contact 42 is then inserted with a press fit into the rear opening 40 of the outer shell contact 36 to complete assembly of the female connector 32 as depicted in FIG. 5E and FIG. 2.

Finally, with respect to the female connector 32 and as previously described with respect to FIG. 2, with the forward and rearward spring contacts 30A and 30B loosely supported within the step 43 and the step 52 respectively, the insertion of the male connector 34 into the outer shell contact 36 produces a vertical orientation and outward expansion of the spring contacts to provide conductive paths for electrical signals (e.g., coded sound signals) from the male contacts to the outer shell and center end contacts for transmission from the female electrical connector of the present invention.

As also previously stated, the forward and rearward spring contacts 30A and 30B are of a "floating" design (meaning, with respect to FIG. 2, that they are not welded, crimped, or otherwise secured or connected to, and loosely supported within, the outer shell contact 36 or to the center end contact 42) and are of a very small design being less than 4 mm in diameter and less that 0.9 mm in total width.

Preferred structures for such floating spring contacts are depicted in FIGS. 6A-6E, 7A-7D and 8A-8C respectively.

Figure 6A:
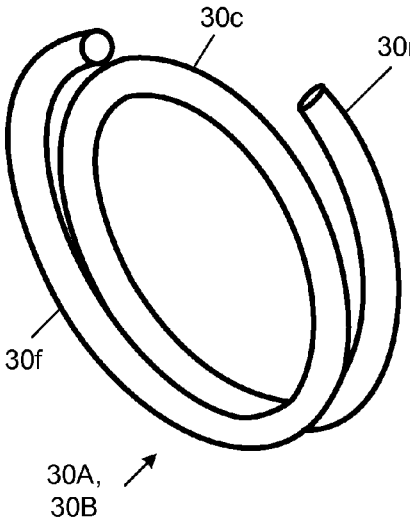
Figure 6C:
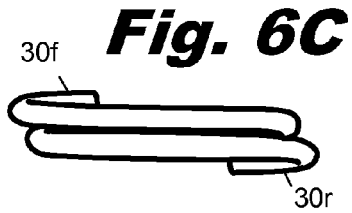
Figure 6B:
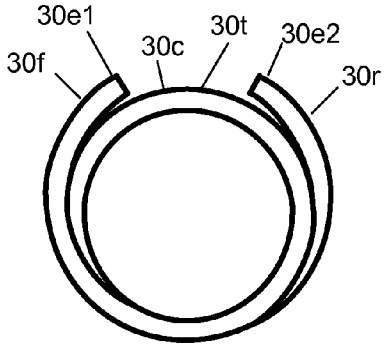
Figure 6D:
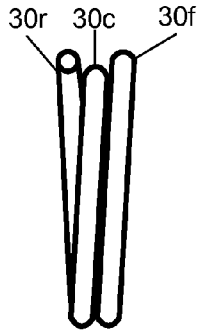
Figure 6E:
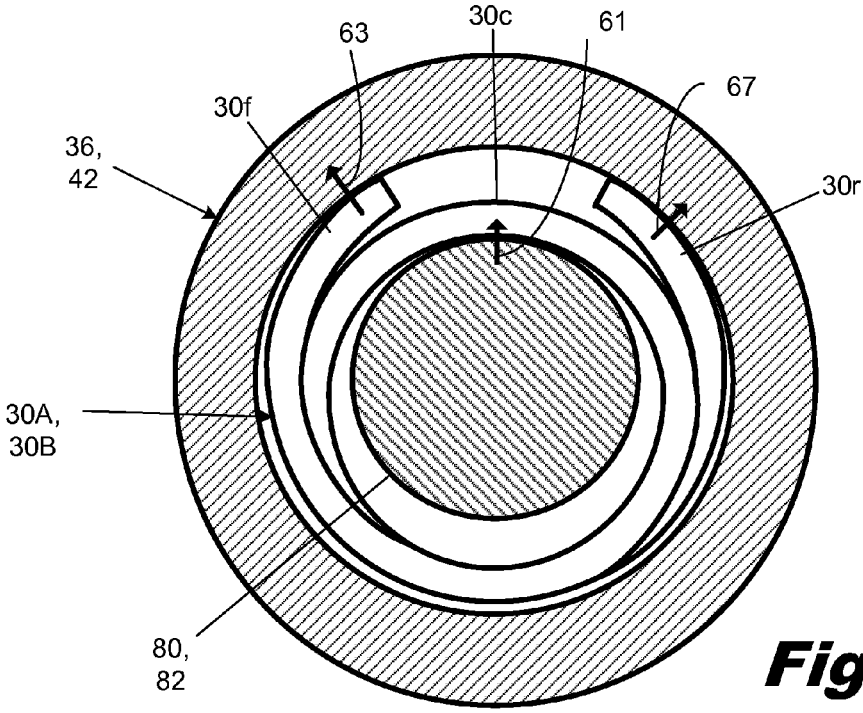
FIG. 6E is a front view of the crab spring contact within a female connector block as it is engaged by a male contact as shown in FIG. 2.

As depicted in FIGS. 6A-6E, a first design of a "floating" and vertically orientable spring useful as the springs 30A and/or 30B in the female connector 32 of the present invention may be referred to as a "crab" spring contact. As shown in FIG. 6A, the crab spring contact of the present invention is formed of a conductive metal wire such as gold plated beryllium copper having a diameter of less than 1 mm. As shown in FIGS. 6A and 6B, the metal wire of the crab spring is formed into a central circular loop 30*c* and partial front and rear loops 30*f* and 30*r* extending upward with ends 30*e*1 and 30*e*2 on opposite sides and above a top surface 30*t* of the central circular loop 30*c*. The width of the crab spring as depicted in FIGS. 6B and 6C is less than 4 mm and depth of the crab spring as depicted in FIGS. 6C and 6D is less than 1 mm.

When a crab spring contact is included in a connector block 36 or 42 of the female connector 32 of the present invention as illustrated in FIG. 2, as a forward end of a male contact 80 or 82 of the male connector 34 engages the crab spring contact and enters the central circular loop 30*c*, it applies an upward force to the central loop as depicted by the arrow 61. The upward force vertically orients the spring contact and is transmitted to the front and rear partial loops 30*f* and 30*r* as outward forces depicted by the arrows 63 and 67. In turn, the outward forces cause the partial loops to firmly engage the inner surface of the structure of the outer shell contact 36 or center end contact 42 in which it is confined to complete a conductive path between the male side contact 80 and the outer shell contact 36 or the center pin contact 82 and center end contact 42 as previously described.

As depicted in FIGS. 7A-7D, a second design of a "floating" and vertically orientable spring useful as the springs 30A and/or 30B in the female connector 32 of the present invention may be referred to as a "wire" spring contact. As shown in FIG. 7A, the wire spring contact of the present invention is formed of a conductive metal wire such as gold plated beryllium copper having a diameter of less than 1 mm formed into a non-circular or "squashed" central loop 30*c* and front and rear partial loops 30*f* and 30*r* extending upward with ends 30*e*1 and 30*e*2 to opposite sides and above a top surface 30*t* of the non-circular central loop 30*c*. The width of the wire spring as depicted in FIGS. 7B and 7C is less than 4 mm and depth of the wire spring as depicted in FIGS. 7C and 7D is less than 1 mm.

When a wire spring contact is included in a connector block 36 or 42 of the female connector 32 of the present invention as illustrated in FIG. 2, as a forward end of a male contact 80 or 82 of male connector 34 engages the wire spring contact and enters the central loop 30*c*, it applies upward forces to the central loop as depicted by the arrows 71, 73 and 75. In response to such forces, the central loop is vertically oriented and expands slightly to a more circular shape transmitting forces represented by the arrows 77 and 79 to the front and rear partial loops 30*f* and 30*r* causing them to move outward and to firmly engage the inner surface of the structure of the outer shell contact 36 or center end contact 42 in which it is confined to complete a conductive path between the male side contact 80 and the outer shell contact or between the center pin contact 82 and the end contact as previously described.

Figure 8A:
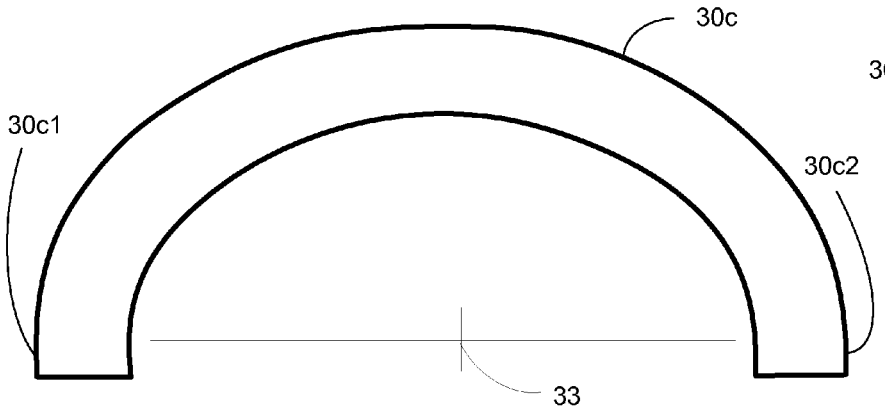
Figure 8B:
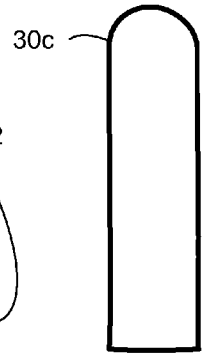
Figure 8C:
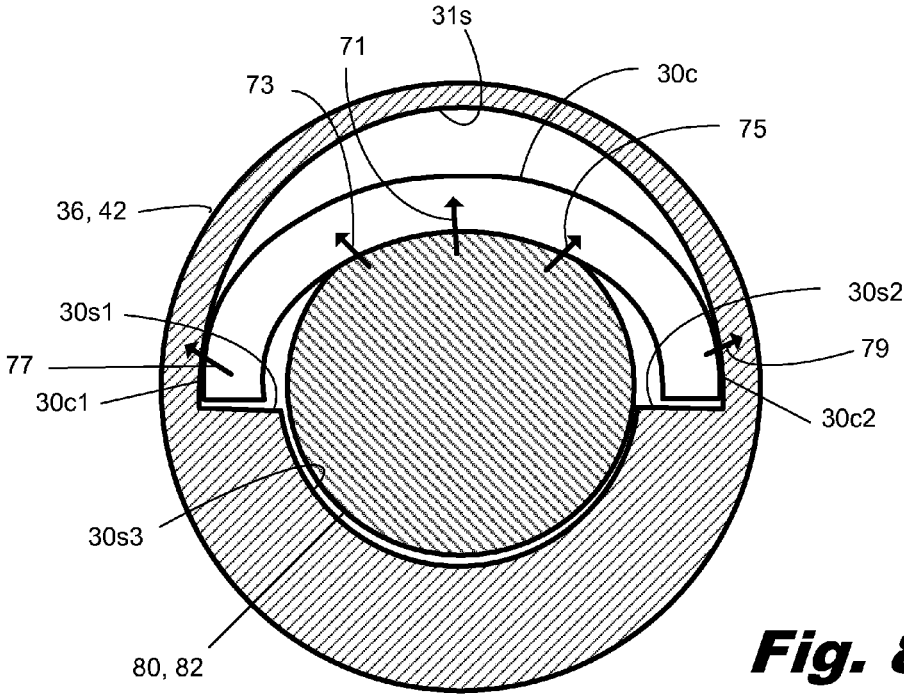
FIG. 8C is a front view of the semi-arc wire spring contact within a female connector block as it is engaged by a male contact as shown in FIG. 2.

As depicted in FIGS. 8A-8C, a third design of a "floating" and vertically orientable spring useful as the springs 30A and/or 30B in the female connector 32 of the present invention may be referred to as a "semi-arc" spring contact. As shown in FIG. 8A, the semi-arc spring contact of the present invention is formed of a conductive metal wire such as gold plated beryllium copper having a diameter of less than 1 mm formed into a generally elliptical arc 30*c*. As shown in FIG. 8A, the semi-arc 30*c* includes ends 30*c*1 and 30*c*2, which may extend a short distance from the tangent to the major diameter of the ellipse, whose center 33 is indicated in FIG. 8A. In an illustrative embodiment, when using a center pin contact 82 or male side contact 80 having a diameter of 1.5 mm in the contact region, the height of the semi-arc 30*c* as measured from center 33 may be about 0.7 mm. As depicted in FIG. 8C, ends 30*c*1 and 30*c*2 are positioned adjacent radially extending end surfaces 30*s*1 and 30*s*2, respectively, of a semi-circular or elliptical shoulder 30*s*3 formed by an inner semi-circular slot 31*s* in the inner surface of the connector block, which may be an outer shell contact 36 or a center end contact 42, shown in FIG. 8C. To apply the semi-arc spring contact 30*c* in the miniature female connector 32 shown in cross section in FIG. 2, the foregoing support structure for the semi-arc spring shown in FIG. 8C would be included in the rearward facing step 43 of the outer shell contact 36 and the forward facing slot 52 in the center end contact 42 as depicted in FIG. 8C. Specifically, the inner surfaces of the rearward facing step 43 and the forward facing slot 52 would include a semi-circular or elliptical slot corresponding to 31*s* forming inwardly extending surfaces 30*s*1 and 30*s*2 of a semi-circular shoulder 30*s*3. As also depicted in FIG. 8C, upon forward movement a male contact 80 or 82 of the male connector 34 within the semi-circular or elliptical shoulder 30*s*3 to engage the elliptical semi-arc 30*c*, it applies upward forces to the semi-arc as depicted by the arrows 71, 73, and 75. These forces vertically orient the semi-arc and tend to outwardly enlarge the arc such that outer portions of the arc apply outward forces to the inner surfaces of connector block 36, 42 as represented by the arrows 77 and 79 in FIG. 8C. With semi-arc spring contacts included in the female electrical connector shown in FIG. 2, corresponding expansion of the semi-arc spring contacts would occur cause the contacts to firmly engage the inner surface of the structure of the outer shell contact 36 or center end contact 42 in which it is confined to complete a conductive path between the male side contact 80 and the outer shell contact or between the center pin contact 82 and the center end contact.

From the foregoing descriptions of the outer shell and central end contacts and the several "floating" spring designs, it is apparent that the female connector 32 and its internal components are designed to receive a male connector. A preferred design of a male connector 34 is shown in FIGS. 2 and 9. The component parts of the illustrated male connector 34 and their method of assembly to form the male connector 34 is depicted in FIG. 10 and FIGS. 11A-11C, respectively.

As shown most clearly in FIGS. 2, 9, and 10, an illustrative male connector 34 for use with the female connector 32 comprises coaxially extending complementary components comprising a side contact 80, a center pin contact 82, and an insulator sleeve 84.

The side contact 80 is formed of a conductive material, such a brass, and comprises an axially-extending cylinder 85 having a central opening 86 for axially receiving the center pin contact 82 and insulator sleeve 84, as depicted in FIGS. 2 and 10. The center pin contact 82 comprises, for example, brass. The insulator sleeve 84 may comprise, for example, polyether ether ketone (PEEK) or an acetal such as Delrin® material.

As shown in FIGS. 9 and 10, the rearward end of the side contact 80 includes two diametrically opposite arc-shaped radial extensions 87 and 88, the extension 87 including a first axially-extending rearward electrical contact 87A and a second axially-extending rearward electrical contact 82A defined by a rearward end of the center pin contact 82 extending beyond the side contact 80.

Spaced axially forward of the radial extensions 87 and 88 is an outer circular groove 90 which, as illustrated in FIG. 2, is designed to receive the retainer 66 to axially secure the male connector 34 within the female connector 32.

Forward of the circular groove 90, the side contact 80 is cylindrical in shape having an outer surface 91 that extends through and radially compresses the seal 62 captured within the inner annular groove 64 in the outer shell contact 36 of the female connector 32, as depicted in FIG. 2.

Forward of the cylindrical outer surface 91, an annular outer surface 92 of the side contact 80 is inwardly inclined and engages and tightly mates with the annular outwardly ramped surface 38A acting as an axial stop for the side contact within the outer shell contact 36.

Forward of the inclined outer surface 92, the outer surface 93 of the side contact 80 is cylindrical and passes through the forward spring contact 30A housed within the annular cavity bounded by step 43 and slightly into the radial inward extension 53 of the insulator 44 where it engages an enlarged radial head portion 89 of the cylindrical insulator sleeve 84 as shown in FIG. 2.

As depicted in FIGS. 10 and 2, the insulator sleeve 84 includes a central longitudinal opening 94 for tightly receiving and insulating a central rod 95 of the center pin contact 82 from the internal structure side contact 80 and the outer shell contact 36. The center pin contact 82 also includes an enlarged forwardly extending cylindrical head 96 from which the rod 95 rearwardly extends and against which the insulator sleeve 84 firmly abuts.

As illustrated in FIG. 2, the cylindrical head 96 of the center pin contact 82 extends axially through the rearward spring contact 30B and into the pocket 48 of the center end contact 42 of the female connector 32 to expand the spring contact and complete a conductive path from the center pin contact to the center end contact.

FIG. 11A-FIG. 11C depict the assembly steps for the male connector 34, beginning with the side contact 80 illustrated in FIG. 11A. First, the insulator sleeve 84 is inserted into the open forward end 86 of the side contact 80 until the head 89 of the insulator sleeve engages the forward end of the side contact as shown in FIG. 11B. Next, the center pin contact 82 is inserted into the longitudinal opening in the insulator sleeve 84 (FIG. 11C) until the enlarged head 96 of the center pin contact engages the head 89 of the insulator sleeve 84 thereby completing the assembly of the male connector 34 shown in FIG. 9.

Figure 12:
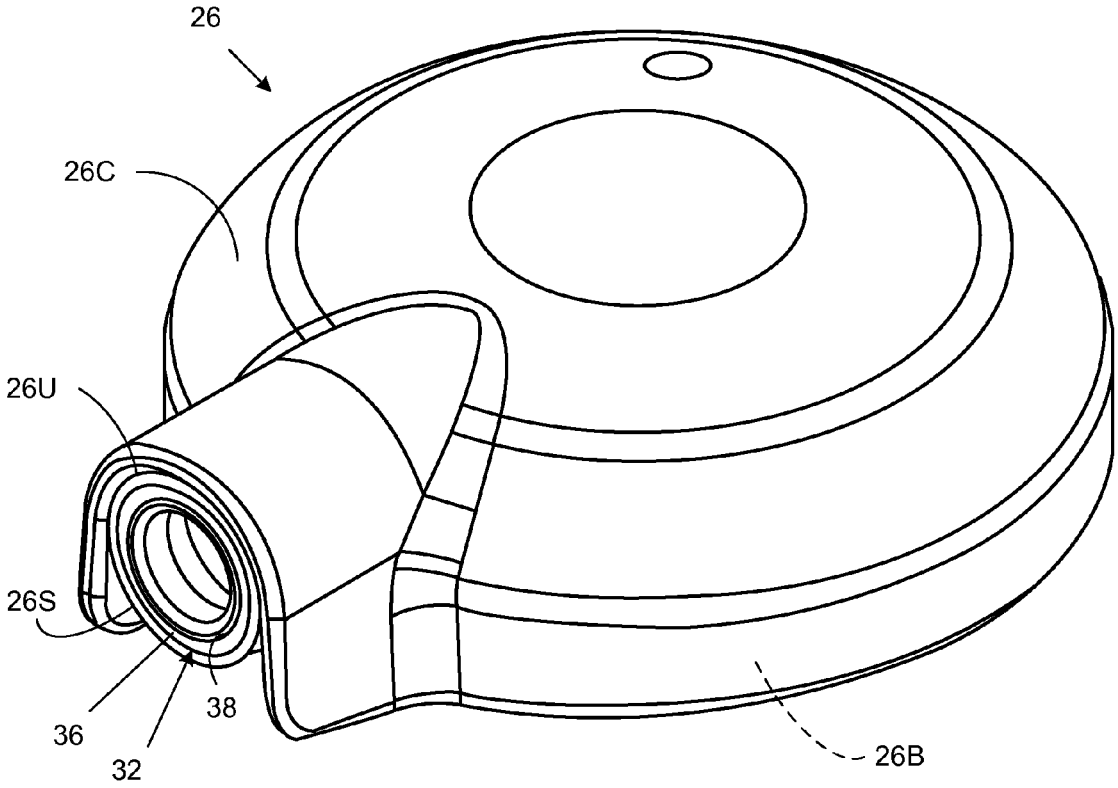
FIG. 12 is an enlarged perspective view of the headpiece shown in FIG. 1B with the female connector seated within an open socket ready to receive the male connector as depicted in FIG. 2.

Thus assembled, the male connector 34 is ready for insertion into the female connector 32 as depicted in FIG. 2. As previously indicated, one of the many important applications of the assembled female and male connectors 32 and 34 is in the cochlear implant system 10 shown in FIG. 1B where the miniature waterproof electrical connector assembly 12 comprising the connectors 32 and 34 connects the cable 24 to the headpiece 26. In that regard, FIG. 12 illustrates the headpiece 26 comprising a bottom cover 26B and an upper cover 26U having a socket 26S formed therein, in which the female connector 32 is seated with its outer shell contact 36 and open forward end 38 ready to receive the male connector 34 as illustrated in FIG. 2. An optional color cover 26C is snapped onto the upper cover. Within the headpiece 26, the contacts 68 and 70 are electrically connected to circuitry for processing the coded sound signals carried by the cable 24 and applied to the contacts 82A and 87A of the male connector as illustrated at 24A in FIG. 2 where the portion of the male connector outside the female connector 32 is encapsulated in a waterproof covering 34A of suitable waterproof material protecting the connection between the cable 24 and male connector 34 and limiting passage of fluid into the opening 38 which otherwise would be blocked by the seals 60 and 62.

While in the foregoing, preferred embodiments of the present invention and the modes of assembly thereof have been described and illustrated, changes and modifications may be made without departing from the spirit of the present invention. Accordingly the present invention is to be limited in scope only by the following claims.

The invention claimed is:

1. A female connector, comprising:

an electrically conductive connector block having an open end for receiving a male contact of a male connector, the connector block comprising a conductive cylindrical axially extending outer shell contact having an open front and rear ends, wherein an inner surface of the open front end within the cylindrical outer shell contact includes a C-shaped laterally extending slot including inner upper and lower laterally extending grooves beginning respectively at upper and lower ends of a vertically extending C-shaped side cutout opening in a side of the outer shell contact and extending laterally to two vertically extending elongated and spaced slots in an opposite side of the outer shell contact and further comprising a laterally elongated C-shaped retainer extending through the vertically extending C-shaped side cutout opening with upper and lower arms of the retainer extending respectively along the upper and lower laterally extending grooves and terminating in the upper and lower vertically elongated slots in the opposite side of the outer shell contact to releasably secure the male connector within the female connector;

a conductive vertically orientable floating spring contact loosely mounted within the connector block for vertical orientation and outward expansion in response to insertion of the male connector contact through the open end to provide a conductive path between the male connector and the connector block; and a second electrically conducive connector block comprising a conductive axially extending center end contact within the open rear end of and insulated from the outer shell contact.

2. A female connector, comprising:

an electrically conductive connector block having an open end for receiving a male contact of a male connector, the connector block comprising conductive cylindrical axially extending outer shell contact having an open front and rear ends;

a second electrically conductive connector block comprising a conductive cylindrical axially extending center end contact within the open rear end of and insulated from the outer shell contact; and first and second conductive floating and vertically orientable spring contacts, the first floating spring contact being loosely mounted within the outer shell contact to be vertically oriented within the outer shell contact and to outwardly expand upon axial insertion of the male connector into the female connector to provide a conductive path between the male connector and the outer shell contact, and the second floating spring contact being loosely mounted within the center end contact to be vertically oriented within the center end contact and to outwardly expand upon axial insertion of the male connector into the female connector to provide a conductive path between the male connector contact and the center end contact.

3. The female connector of claim 2 wherein the cylindrical outer shell contact includes a cylindrical rear opening extending forward to a mid-portion of the outer shell contact where it steps inward toward an axis of the outer shell to form a rearward facing circular shoulder and a cylindrical rearwardly facing open step upon which the first floating spring contact rests within the outer shell contact for vertical orientation within the outer shell contact and outward expansion in response to the axial insertion of the male connector contact into the open forward end of the outer shell contact.

4. The female connector of claim 3 wherein the center end contact comprises a forwardly facing cylindrical pocket for receiving a forward end of the male connector contact upon its insertion into the female connector and a forward facing annular step within a forward face of the cylindrical pocket forming a cavity for loosely receiving the second spring contact for vertical orientation within the cavity and outward expansion in response to the axial insertion of the male connector contact into the open forward end of the outer shell contact.

5. The female connector of claim 4 wherein an insulator electrically insulates the center end contact from the outer shell contact.

6. The female connector of claim 5 wherein the insulator comprises a sleeve including a cylindrical portion between an outer cylindrical surface of the center end contact and a cylindrical inner surface of the outer shell contact and a radial portion between ends of the forwardly facing pocket in the center end contact and an inner surface of the outer shell contact to close a rearward open side of the open step that loosely supports the first spring contact within the outer shell contact and to close the forward facing step within the forward face of the cylindrical pocket that loosely supports the second spring contact within the outer shell contact.

7. The female connector of claim 6 wherein the radial portion of the insulator includes an inner circular channel supporting a first circular seal sized and shaped to expand upon insertion of the male connector into the female connector to create a fluid tight seal between an outer surface of the male connector and the insulator.

8. The female connector of claim 7 wherein an inner surface of the open front end within the cylindrical outer shell contact forward of the first spring contact includes an annular recess containing a second circular seal sized and shaped to expand upon insertion of the male connector into the female connector to create a fluid tight seal between an outer surface of the male connector and the outer shell contact.

9. The female connector of claim 8 wherein an inner surface of the open front end within the cylindrical outer shell contact includes a C-shaped laterally extending slot including inner upper and lower laterally extending grooves beginning respectively at upper and lower ends of a vertically extending C-shaped side cutout opening in a side of the outer shell contact and extending laterally to two vertically extending elongated and spaced slots in an opposite side of the outer shell contact and further comprising a laterally elongated C-shaped retainer extending through the vertically extending C-shaped side cutout opening with upper and lower arms of the retainer extending respectively along the upper and lower laterally extending grooves and terminating in the in the upper and lower vertically extending slots in the opposite side of the outer shell contact to releasably secure the male connector within the female connector and the C-shaped laterally extending slot and the retainer are located forward of the second circular seal.

10. The female connector of claim 2 wherein one or both of the floating spring contacts comprises a conductive metal wire crab spring contact having a central circular loop and partial front and rear loops extending upward from the central loop with ends on opposite sides and above a top surface of the circular loop.

11. The female connector of claim 2 wherein one or both of the floating spring contacts comprises a conductive metal wire spring contact having a central non-circular loop and semi-circular front and rear loops extending upward from the non-circular central loop with ends on opposite sides and above a top surface of the non-circular loop.

12. The female connector of claim 2 wherein one or both of the floating spring contacts comprises a conductive metal wire elliptical semi-arc spring contact having ends respectively resting on inwardly extending shoulders within the outer shell contact and the center end contact.

13. The female connector of claim 2 wherein one or both of the floating spring contacts comprises a conductive metal wire elliptical semi-arc spring contact having ends respectively resting on inwardly extending shoulders formed by ends of semi-circular outer slots in the rearward facing step within in the outer shell contact and the forward facing slot in the center end contact such that upon contact with the forward end of the male connector contact and the elliptical arc of the first and second spring contacts are outwardly enlarged to force outer portions of the elliptical arc adjacent the ends thereof against inner surfaces of outer shell contact and center end contact to complete electrical paths between the male connector contact and the outer shell contact and the center end contact respectively.

14. A combination of the female connector of claim 2 and an axially elongated male connector for insertion into an axial opening in a forward end of the outer shell contact to vertically orient and outwardly expand the first and second floating spring contacts and create electrical paths from the male connector to electrical contacts extending from the female connector.

15. The combination of claim 14 wherein the male connector comprises:

a cylindrical side contact formed of a conductive material for engaging and expanding the first floating spring contact to complete an electrical path between the side contact and the outer shell contact, the cylindrical side contact having a central opening axially receiving a center pin of conductive material extending from an insulator sleeve, and the center pin including a rod electrical contact extending rearward beyond the cylindrical side contact and including an enlarged head engaging and expanding the second floating spring contact within the center end contact to complete an electrical path between the rod electrical contact of the male connector and the center end contact of the female connector.

16. The combination of claim 15 wherein the female connector includes internal seals engaged by the side contact and the center pin respectively to create a fluid tight seal between the side contact and the outer shell contact and between the center pin and the center end contact.

17. The combination of claim 15 further including an outer groove in the side contact receiving a retainer extending through the outer shell contact to axially and releasably secure the side contact within the outer shell contact.

18. The combination of claim 16 wherein the side contact includes an inclined annular outer surface for mating with an annular outwardly inclined surface within the axial opening of the outer shell contact to define an axial stop for the side contact within the outer shell contact.

19. The combination of claim 15 wherein the side contact and the center pin of the male connector are electrically connected to electrical leads in a cable for transmitting electrical signals from the cable to the female connector.

20. The combination of claim 19 wherein the side contact and the center pin external to the female connector are encapsulated in a waterproof covering.

21. A method of assembly of the miniature female connector of claim 8, comprising:

insertion of the first circular seal into the annular channel inside the outer shell contact, followed by insertion of the retainer into the outer shell contact through the side cutout with the upper and lower arms of the retainer riding into the grooves until the ends of the retainer extend into side openings in the outer shell contact, followed by insertion of the first floating spring contact through a front of the cylindrical opening into the outer shell contact to loosely seat within the open step, followed by insertion of the second floating spring contact into the open pocket of the center end contact to loosely seat within the forward facing annular slot, followed by insertion of the second annular seal into the inner circular channel in the insulator, followed by insertion of the center end contact into the open rear end portion of the insulator, followed by insertion of the insulator and the center end contact into the rear opening of the outer shell contact to complete assembly of the female connector.

* * * * *